US006098499A

United States Patent [19]

Pool

[11] Patent Number: 6,098,499

[45] Date of Patent: Aug. 8, 2000

[54] BOLT EXTRACTION TOOL

[75] Inventor: James L. Pool, Clarinda, Iowa

[73] Assignee: The Lisle Corporation, Clarinda, Iowa

[21] Appl. No.: 09/116,523

[22] Filed: Jul. 16, 1998

[51] Int. Cl.[7] ..... B25B 13/50

[52] U.S. Cl. ..... 81/53.2; 81/441

[58] Field of Search ..... 81/53.2, 441

[56] References Cited

U.S. PATENT DOCUMENTS

| | | | |
|---|---|---|---|
| 1,547,944 | 7/1925 | Murphree | 81/53.2 |
| 1,604,032 | 10/1926 | Ferrell | 81/441 |
| 2,121,197 | 6/1938 | Jackman | 81/441 |

*Primary Examiner*—Willie Berry, Jr.
*Attorney, Agent, or Firm*—Banner & Witcoff, Ltd.

[57] ABSTRACT

An improved tool extractor includes a head end and a broach end. The broad end includes a series of symmetrically arranged recesses and ribs generally defined about a longitudinal axis of the broach end.

6 Claims, 2 Drawing Sheets

FIG.5
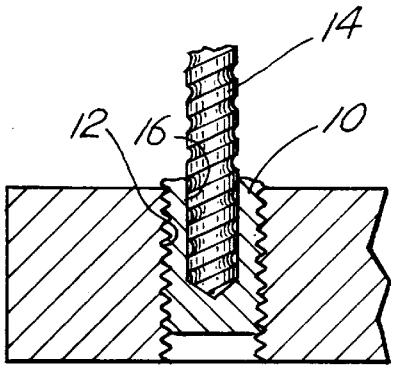
FIG.6
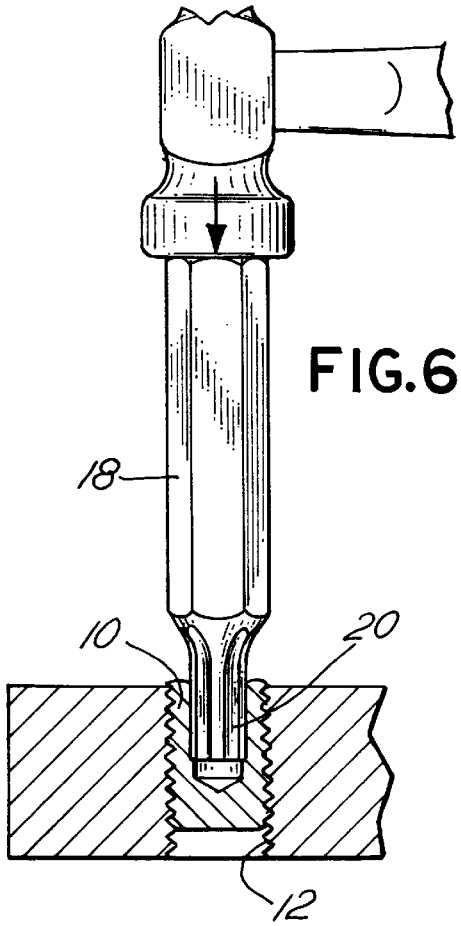
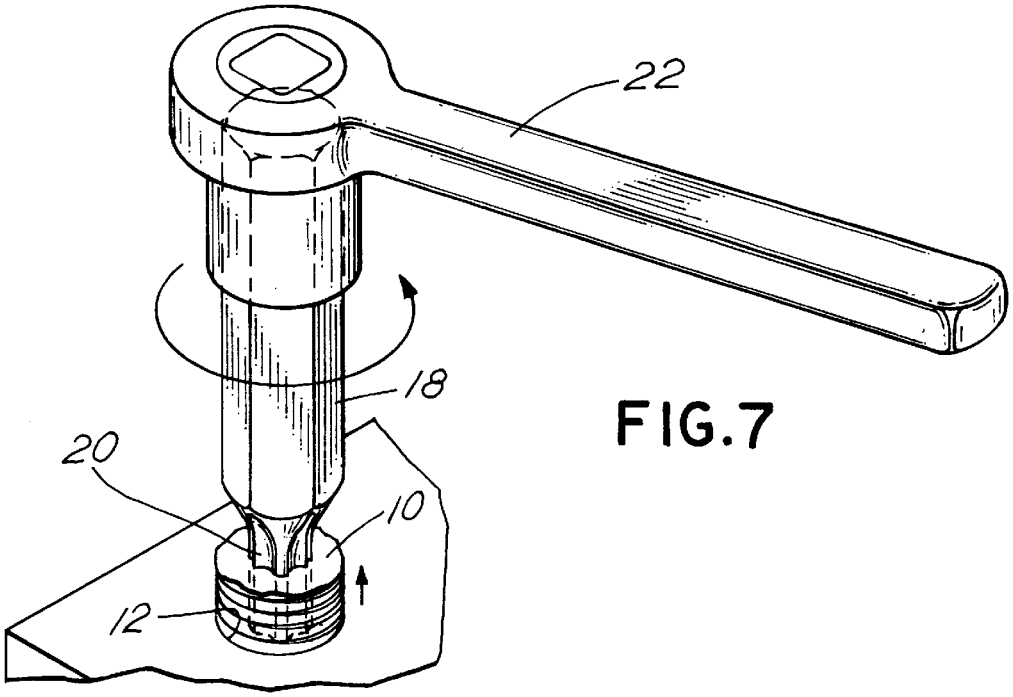
FIG.7

BOLT EXTRACTION TOOL

BACKGROUND OF THE INVENTION

In a principal aspect, the present invention relates to a tool which can be used to extract a bolt or screw from a bore where the head of the bolt or screw has been removed, for example, by fracture or otherwise. The tool is typically termed a bolt and screw extractor and is part of a family of tools having the form of a tap.

Heretofore, such tools have been available and typically include a hexagonal head which can be turned by a wrench or the like and an extractor or broach end which is driven into a counterbore drilled into the bolt or screw. The extractor end or broach end is typically fluted, for example, by knurling so that V-shaped grooves and ribs extend longitudinally around the periphery of the broach end of the tool. In this manner, when the tool is driven into a hole drilled in a bolt or screw, the ribs will grip or cut into the sides of the hole. The tap or extractor may then be rotated, for example, by a wrench to thereby extract or remove the bolt or screw.

Heretofore, the steel commonly used to make such extractors has the ANSI designation as S7 steel. More recently, a new steel material has been utilized for such extractor tools; namely, ANSI S2 designation steel. The new steel has been useful, but has some inherent problems because it is notch sensitive. That is, the V-shaped slots cut in the side of the tool to form the ribs, will fracture when subjected to stress, thus destroying the capability of the tool to serve as an efficient extractor. The present invention addresses this, among other problems.

SUMMARY OF THE INVENTION

Briefly, the present invention comprises an extractor which has the shape of a tap member with a driving head end and a broach end. The ends are generally concentric. The head end is shaped to receive a rotational driver and also includes a land for impact on the tool to drive it into a drilled opening in a bolt or screw that is to be extracted. The broach end includes a longitudinal axis which is generally coaxial with the head end. A series of arcuate recesses and ribs are defined about the broach end and are parallel to the axis. Each rib and each recess has a uniform radial arc cross section and ribs alternate with recesses about the periphery of the broach end. Preferably, the radius of the ribs, which have a convex shape, is in the range of 25–45% of the radius of the recess which has a concave shape. With the manufacture of the extractor tool of the invention in accord with the description and claims, it has been found that it is possible to utilize ANSI S2 steel in a very successful manner. Extractors made in accord with the mechanical characteristics disclosed and claimed provide for an increase in failure torque of one-third (⅓), thus enabling use of the tool in many more environments and also prolonging tool life.

Thus, it is an object of the invention to provide an improved extractor tool.

It is a further object of the invention to provide an extractor tool which may be manufactured and used successfully starting with ANSI S2 steel material as the material for manufacture of the tool.

Another object of the invention is to provide an improved extractor tool which can be manufactured utilizing present day manufacturing techniques in an economic, efficient and high production capacity manner.

Yet another object of the present invention is to provide an improved extractor tool which includes a cross sectional profile of alternating ribs and recesses having an arcuate shape.

These and other objects, advantages and features of the invention will be set forth in the detailed description which follows.

BRIEF DESCRIPTION OF THE DRAWINGS

In the detailed description which follows, reference will be made to the drawing comprised of the following figures:

FIG. 5 is a diagrammatic view of a step in the process of utilization of extractor tools;

FIG. 6 illustrates a further step in the utilization of an extractor tool; and FIG. 7 illustrates the further utilization of an extractor tool to remove a broken bolt, screw or the like.

DESCRIPTION OF THE PREFERRED EMBODIMENT

Figure 1:
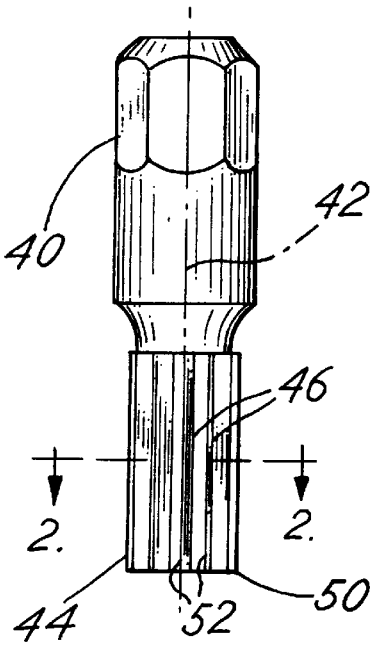
FIG.1 PRIOR ART
FIG. 1 is an elevation of a prior art extractor tool.
Figure 2:
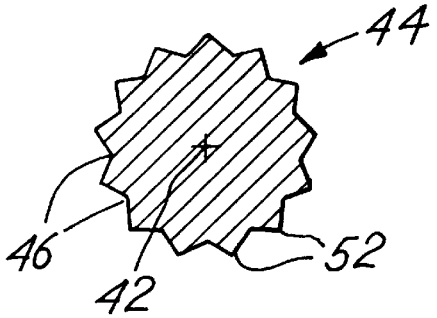
FIG. 2 PRIOR ART
FIG. 2 is a cross sectional view of the broach end of the prior art extractor of FIG. 1 taken along the line 2—2.
Figure 3:
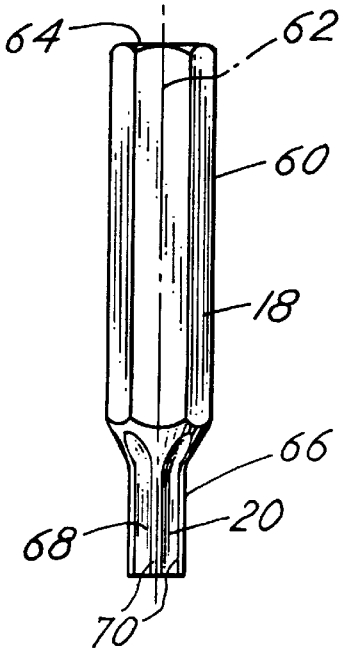
FIG. 3 is an elevation of the improved extractor tool of the invention.
Figure 4:
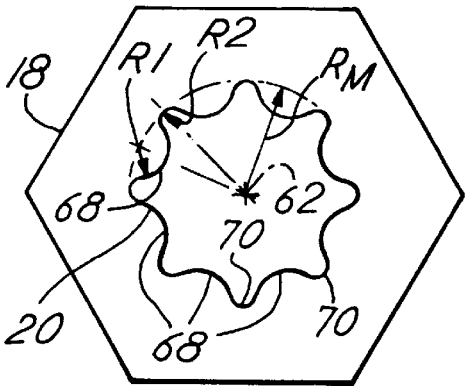
FIG. 4 is a broach end view of the extractor of FIG. 3 depicting the cross sectional shape of the broach end along the longitudinal axis of the extractor.

FIGS. 5, 6 and 7 illustrate the method of utilization of extractor tools of the type shown in FIGS. 1 and 2, as well as the improved extractor tool of FIGS. 3 and 4. The improved extractor tool of FIGS. 3 and 4, however, is useful in situations where higher torque is necessarily applied to the tool in order to remove a broken bolt or screw. Thus, to provide an overview, reference is first directed to FIG. 5 wherein there is schematically illustrated a broken bolt 10 which has been threaded into a bore 12 in a plate, for example. The bolt 10 is fractured or broken, thus precluding its removal by engaging the head of the bolt and twisting or turning. As a first step in its removal using an extractor tool, a bit or drill 14 is utilized to drill a hole 16 within the bolt 10. In practice, the opening or hole 16 drilled in the bolt 10 has a lesser diameter than the bolt 10, of course, and is of appropriate size so that an extractor tool may be driven into the opening 16.

Referring next to FIG. 6, the tool is driven into the bolt. The tool comprises a head 18 and a knurled end 20. The knurled end 20 is driven into the opening 16 and deforms the size of the opening 16 in a manner to tightly grip or effect a grip between the tool and the opening 16. Thereafter, a ratchet 22 is applied to head 18 and rotated about the axis of the bolt 10 and the tool. In this manner, the bolt 10 is extracted.

FIGS. 1 and 2 illustrate a prior art extractor construction. The extractor includes a driving head 40, a center line axis 42 about which the driving head 40 is concentric, and an extraction or broach end 44. The extraction end 44 includes a series of longitudinal grooves or slots 46 generally parallel to the center line axis 42. FIG. 2 comprises a cross sectional view of the broach end or active end 44 of the tool of FIG. 1 taken along the line 2—2 in FIG. 1. The cross sectional view is transverse to the center line axis 42. The cross sectional configuration of the broach end 44 is substantially uniform along the length of the end 44. However, the bottom or leading end of the tool 50 may be slightly rounded in order to facilitate entry of the broach end 44 into a drilled opening 16. In any event, the cross sectional configuration depicted in FIG. 2 illustrates that the grooves 46 are generally V-shaped and extend outwardly to define points 52 arranged symmetrically around the center line axis 42 of the broach end 44. The configuration described when using an ANSI S2 steel has a failure torque especially in the smaller sized extractors. Further cracks develop in the device apparently because of the V-shaped grooves 46 and sharp points 52.

FIGS. 3 and 4 illustrate the improved extractor of the invention. The improved extractor comprises a tap member having a driving head 60, a center line axis 62 and a land at one end, namely, land 64 for receipt of impact of a driving tool such as a hammer. The tool further includes a broach end 66 which includes 8 recesses which are generally concave, namely recesses 68 with ribs 70 which are convexed intermediate each of the adjacent recesses 68. The recesses 68 are arcuate in shape and include a radius R1 centered on a radius of the broach end projecting through the center line 62. Thus, the radius R1 lies on a major radius $R_M$ passing through the center line 62. Similarly, each rib 70 includes a radius R2 which lies on a major radius $R_M$ through the axis 62. The radius R2 has a dimension which is typically in the range of 25–45% of the radius of the recess R1 and preferably in the range of approximately 30–37% thereof. The ribs 70 are equally spaced from one Similarly, the radii of the recesses 68 lie on the same circle centered on the axis 62. Note that the driving head 60 has a polygonal cross section so that it may be easily gripped by a wrench or other similar driving tool.

The extractor tool of the invention can be made in various sizes. When comparing extractors made in accord with the teachings of the present invention as contrasted to those made in accord with the prior art as depicted in FIGS. 1 and 2, it was found that the failure torque of the extractor of the present invention was significantly increased approximately one-third (⅓) in many instances. Following is a table setting forth the experimental results comparing the prior art extractors with those which are the subject matter of the present application:

TABLE 1

| SIZE | BOLT SIZE | PRIOR ART EXTRACTOR FAILURE TORQUE | FIGURES 3/4 EXTRACTOR FAILURE TORQUE |
|---|---|---|---|
| 1 - 62560 | 1/4 | 15 Lb. Ft. | 20 Lb. Ft. |
| 2 - 62570 | 5/16 | 30 Lb. Ft. | 40 Lb. Ft. |
| 2½ - 62730 | 3/8 | 45 Lb. Ft. | 65 Lb. Ft. |
| 3 - 62580 | 7/16 | 100 Lb. Ft. | 105 Lb. Ft. |
| 4 - 62590 | 1/2 | 250 Lb. Ft. | 260 Lb. Ft. |

Conducting the tests for which the results are reported in Table 1, the following procedure was used: a cold finished bar was drilled to provide proper sized holes for the different extractors. The extractors were then driven into the holes and the bar was clamped in a vice. Each extractor was then torqued to failure with a torque wrench. It was noted that the prior art extractor sometimes developed cracks in the splines. This resulted in a further reduction in strength and utility. The extractor of the present invention did not demonstrate any crack development.

It is possible to vary the construction of the invention while still being within the scope and spirit thereof. For example, in the preferred embodiment, eight ribs and eight recesses are set forth about the periphery concentric on the center line axis 62. The use of eight ribs and eight recesses for all sizes of extractor is deemed preferable. However, using various other numbers of ribs and recesses in combination is appropriate. For example, six, seven, nine or ten ribs is quite possible and even other numbers of ribs may be utilized, depending upon the size of the extractor and other factors. Further, the radial cuts in the broach end of the extractor are preferred in the manner described. However, it is possible to skew the radial cuts and thus skew the recesses and ribs in various patterns while still being within the scope of the invention. Additionally, the ribs and recesses are defined as being parallel and generally aligned with the axis 62 in the preferred embodiment. However, it is contemplated that the ribs and recesses may have configurations along the length of the axis 62, for example, a spiral configuration or some other configuration. Further, the ribs and recesses may be defined so that they are discontinuous along the length of the axis 62. Thus, while there has been set forth preferred embodiments of the invention, the invention is to be limited only by the following claims and equivalents.

I claim:

1. A tool for extracting a bolt or screw from a bore wherein the head of the bolt or screw is removed comprising, in combination:

a tap member having a driving head end and a broach end, said ends being generally concentric, said head end shaped to receive a rotational driver and having a distal land for impact on the tool; and said broach end having a longitudinal axis and a series of alternating recesses and ribs about the circumference of the broach and parallel to the axis, each recess and each rib having a substantially uniform, single radial arc cross sectional configuration transverse to the axis and alternating between a smoothly curved concave recess and a convex rib, said cross sectional profile being uniform along a length of the axis, said radius of said curved, convex rib in the range of 25–45% of the curved, concave radius of the recess, said ribs and recesses being uniformly and equally separated from one another.

2. The tool of claim 1 comprising eight (8) pairs of ribs each pair separated by one (1) recess.

3. The tool of claim 1 wherein the driving head includes a polygonal drive shaft concentric with the axis.

4. The tool of claim 1 wherein the radius of the rib is in the range of 30–37% of the radius of the recess.

5. The tool of claim 1 wherein the centers for the radii of each rib lie on the same circle concentric with the axis.

6. The tool of claim 1 wherein the centers for the radii of each recess lie on the same circle concentric with the axis.

* * * * *